US008936034B2

(12) United States Patent
Rhett, Jr.

(10) Patent No.: US 8,936,034 B2
(45) Date of Patent: Jan. 20, 2015

(54) HAMMOCK ENCLOSURE

(71) Applicant: Richard G. Rhett, Jr., Vicksburg, MS (US)

(72) Inventor: Richard G. Rhett, Jr., Vicksburg, MS (US)

( * ) Notice: Subject to any disclaimer, the term of this patent is extended or adjusted under 35 U.S.C. 154(b) by 0 days.

(21) Appl. No.: 13/906,268

(22) Filed: May 30, 2013

(65) Prior Publication Data

US 2014/0158174 A1 Jun. 12, 2014

Related U.S. Application Data

(60) Provisional application No. 61/653,325, filed on May 30, 2012.

(51) Int. Cl.

| | |
|---|---|
| ***E04H 15/04*** | (2006.01) |
| ***E04H 15/02*** | (2006.01) |
| ***A45F 3/22*** | (2006.01) |
| ***E04H 15/34*** | (2006.01) |

(52) U.S. Cl.

CPC ..... *E04H 15/34* (2013.01)
USPC ..... 135/90; 135/96; 5/121

(58) Field of Classification Search

CPC ..... A47C 29/00; A47C 29/006; E04H 15/02; E04H 15/04; A45F 3/22; A45F 3/24
USPC ..... 135/90, 96; 5/121, 128, 130
See application file for complete search history.

(56) References Cited

U.S. PATENT DOCUMENTS

| | | | | |
|---|---|---|---|---|
| 968,017 | A * | 8/1910 | Wilson | 5/121 |
| 4,308,883 | A * | 1/1982 | Malone | 135/90 |
| 5,072,465 | A * | 12/1991 | Lyons, Jr. | 5/121 |
| 7,627,913 | B2 * | 12/2009 | Clark | 5/120 |
| 7,699,068 | B2 * | 4/2010 | Helsdon | 135/90 |
| 2012/0005827 | A1 * | 1/2012 | Clark et al. | 5/121 |

FOREIGN PATENT DOCUMENTS

| | | | |
|---|---|---|---|
| DE | 3425145 | A1 * | 3/1985 |
| DE | 29823920 | U1 * | 1/2000 |
| DE | 10333633 | A1 * | 3/2005 |

* cited by examiner

*Primary Examiner* — David R Dunn
*Assistant Examiner* — Danielle Jackson
(74) *Attorney, Agent, or Firm* — Samuel M. Freund; Cochran Freund & Young LLC

(57) ABSTRACT

A hammock enclosure including a rain fly, insect netting, and a load-bearing gear sling for providing the user of the hammock protection from rain, wind, and insects, and for permitting gear suspended above the ground surface to be stored in the same protected area, while providing access to the gear from both inside and outside of the enclosure, is described. The enclosure further includes opposing tubular end portions disposed in the rain fly through which the load-bearing suspension lines of the hammock pass, whereby protection is provided without having to deploy the enclosure such that it is centered over the hammock, once the tubular end portions are tightened about the suspension lines. The tubular portions further permit the present enclosure to be used with any camping hammock.

14 Claims, 6 Drawing Sheets

HAMMOCK ENCLOSURE

CROSS-REFERENCE TO RELATED APPLICATIONS

The present application claims the benefit of U.S. Provisional Patent Application No. 61/653,325 for "Hammock Enclosure" by Richard G. Rhett, Jr., which was filed on 30 May 2012, the entire content of which is hereby specifically incorporated by reference herein for all that it discloses and teaches.

FIELD OF THE INVENTION

The present invention relates generally to insect and water repellant enclosures and, more particularly, to an insect and water repellant hammock enclosure.

BACKGROUND OF THE INVENTION

Portable hammocks are an alternative to sleeping on the ground in wilderness travel. However, in their simplest embodiments, hammocks leave the user exposed to insects and the elements. Rain tarps are available as detached units, but do not include insect netting. Systems incorporating a hammock having fold-away netting and a detachable rain fly, or a hammock, insect netting and a rain fly comprising a single unit are available, as is a tent system having insect netting attached to a rain fly for enclosing a hammock. These systems require that the rain fly be centered over the hammock, but still permit water flowing along load-bearing hammock supports to reach the hammock.

Moreover, there are no hammock enclosures which permit heavy gear to be suspended above the ground and stored in the same enclosure as the hammock, thereby permitting accessibility by the occupant either from inside or from outside of the enclosure.

SUMMARY OF THE INVENTION

Embodiments of the present invention overcome the disadvantages and limitations of the prior art by providing a hammock enclosure for protection from rain, wind and insects.

Another object of embodiments of the present invention is to provide a hammock enclosure which does not have to be centered over the hammock to protect the hammock from rain.

Yet another object of embodiments of the invention is to provide a hammock enclosure which permits the suspension of heavy gear above the ground within the enclosure, while allowing access thereto either from inside the enclosure or exterior thereto.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

To achieve the foregoing and other objects, and in accordance with the purposes of the present invention, as embodied and broadly described herein, an embodiment of the enclosure for a camping hammock having two load-bearing suspension lines suspension lines affixed to opposing ends thereof, hereof, includes: an elongated, A-frame shaped rain fly effective for protecting the hammock from precipitation, having two long sides each side having a free edge and a common edge disposed above the free edges, the rain fly further having a first closed end and a second closed end at opposing ends thereof extending to the free edge of each side of the rain fly, forming thereby an open end of the rain fly, each of the first end and the second end having a closable sleeve portion, and having an opening through which the suspension lines of said hammock exiting the rain fly are threaded, and attachment locations along the common side of the rain fly for attaching supporting lines; two elongated wing portions each having two opposing long edges, one long edge thereof being attached to or integrally formed with the open end of the rain fly, the opposing long edge thereof having attachment locations for stabilizing lines effective for maintaining the rain fly in an expanded condition; a gear sling disposed below the hammock and protected by the rain fly from precipitation, having attachment locations at opposing ends thereof for attaching at least one supporting line to one of the load-bearing suspension lines affixed to opposing ends of the hammock; a first zipper; and insect-proof netting attached to the rain fly along the open end thereof in part by the first zipper, and attached to the gear sling; whereby the hammock is enclosed by the rain fly, the gear sling and the insect-proof netting, thereby protecting said hammock from precipitation and insects.

Benefits and advantages of embodiments of the present invention include, but are not limited to, providing a camping hammock enclosure for rain, wind and insect protection, while permitting the enclosure to be assembled without requiring exact centering over the hammock, which is of importance since other tarp systems for rain protection of hammocks require that they be centered over the hammock; otherwise water may drip down onto the hammock. The present enclosure may be used with any camping hammock. Additionally, the enclosure permits gear suspended above the ground surface to be stored in the same protected area, while providing access to the gear from both inside and outside of the enclosure.

BRIEF DESCRIPTION OF THE DRAWINGS

The accompanying drawings, which are incorporated in and form a part of the specification, illustrate the embodiments of the present invention and, together with the description, serve to explain the principles of the invention. In the drawings.

DETAILED DESCRIPTION OF THE INVENTION

Briefly, embodiments of the present invention include a camping hammock enclosure including a rain fly, insect netting, and a load-bearing gear sling for providing the user of the hammock protection from rain, wind, and insects, and for permitting gear suspended above the ground surface to be stored in the same protected area, while providing access to the gear from both inside and outside of the enclosure. The enclosure further includes opposing sleeve portions disposed in the rain fly through which the load-bearing suspension lines of the hammock exit the enclosure, whereby protection is provided without having to deploy the enclosure such that it is centered over the hammock, once the sleeve portions are tightened about the suspension lines. The sleeve portions further permit the present enclosure to be used with any camping hammock. As used throughout, the terms "hammock" or "camping hammock" may include portable hammocks designed specifically for being suspended between two effectively immovable objects, the term "rain fly" may include tarpaulins or tarps, and the term "gear sling" may include containers, which may be open, partially open, or closed, suitable for holding gear. The term "gear" may include portable articles for which protection from precipitation or insects is desirable.

Figure 1:
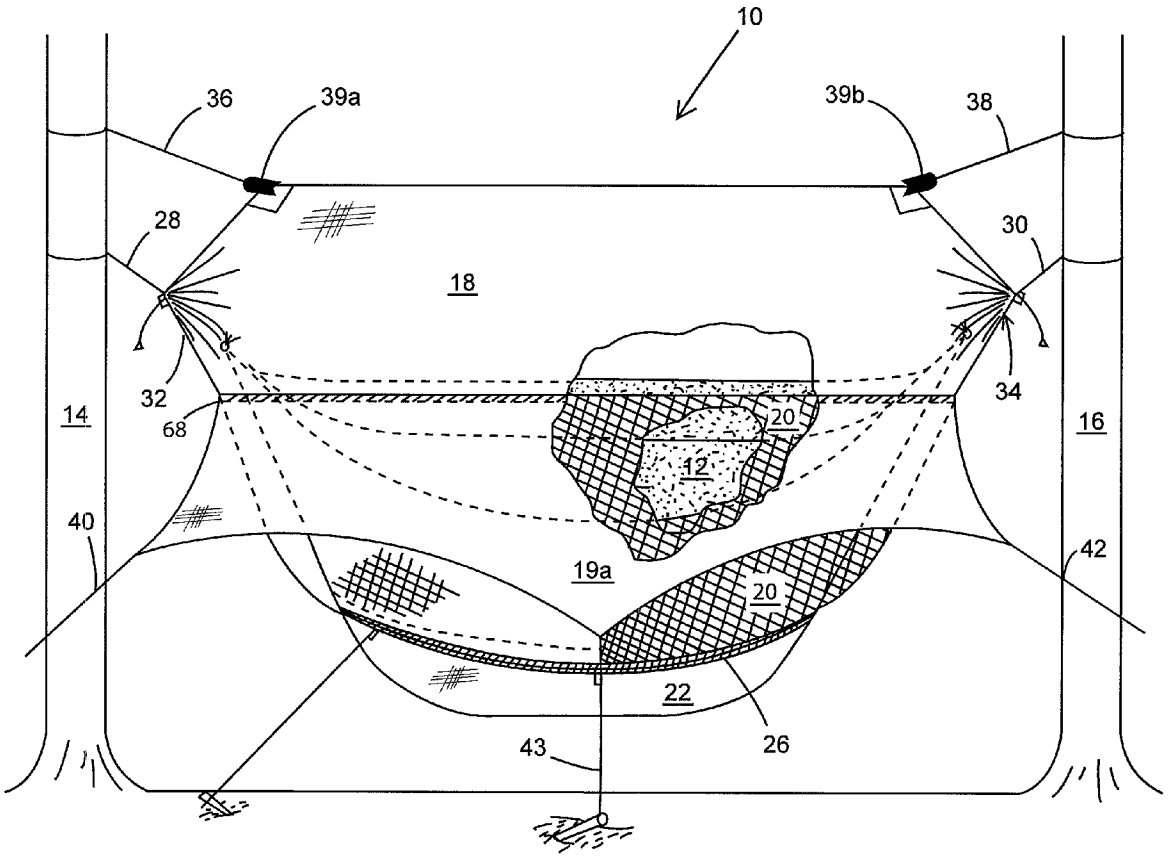
FIG. 1 is a schematic representation of a perspective side view of an embodiment of the enclosure of the present invention surrounding a hammock suspended between two trees, illustrating the rain fly, the insect netting, the gear sling, and various suspension and other tie lines.

Reference will now be made in detail to the present embodiments of the invention, examples of which are illustrated in the accompanying drawings. In the FIGURES, similar structure will be identified using identical reference characters. It will be understood that the FIGURES are presented for the purpose of describing particular embodiments of the invention and are not intended to limit the invention thereto. Turning first to FIG. 1, a schematic representation of a perspective side view of an embodiment of enclosure, 10, of the present invention surrounding camping hammock, 12, suspended between two trees, 14, 16, is shown, illustrating rain fly, 18, insect-proof netting, 20, and load-bearing gear sling, 22, wherein rain fly 18, insect-proof netting 20, and load-bearing gear sling 22 sewn or otherwise connected together form the exterior of enclosure 10, and various suspension lines and tie lines, to be identified hereinbelow. Zipper, 26, permits access to gear stored in load-bearing gear sling 22 either from outside enclosure 10 or internal thereto. Gear sling 22 may be made from waterproofed nylon, or other suitable waterproof materials such as cordura and polyester. The materials may include rip stop materials. Hammock suspension lines, 28, 30, exit sleeve portions, 32, 34, of rain fly 18, respectively, and are fastened to trees 14 and 16, respectively. Sleeves 32 and 34 may then be reversibly closed around hammock suspension lines 28 and 30, respectively, using the adjustable closures to be described hereinbelow, thereby sealing enclosure 10 from rain and insects. The closures may be opened for removing suspension lines 28 and 30 when removing hammock 12 from enclosure 10, or for inserting lines 28 and 30 into sleeves 32 and 34 during assembly of hammock 12 and enclosure 10.

Rain fly 18 is attached to trees 14 and 16 using lines, 36, and, 38, attached to rain fly 18 using waterproof patches, 39*a*, and, 39*b*, respectively, and to stakes (not shown in FIG. 1) by lines, 40, 42, and, 43, on the side of enclosure 10 shown in FIG. 1, with similar attachments on the other side of rain fly 18. The six attachment points, one at each tip of wing, 19*a*, with corresponding identical wing, 19*b*, on the other side of rain fly 18, assist in anchoring and stabilizing enclosure 10 in windy conditions, and in keeping enclosure 10 expanded.

Rain Fly 18 is constructed to keep rain from making contact with insect-proof netting 20 at all areas of connection between rain fly 18 and insect-proof netting 20. Wings 19*a* and 19*b*, are extended at least ~1 in. to the front and rear of the rain fly (left and right of the enclosure, not shown in FIG. 1, but see extension, reference character, 45, in FIG. 6 hereof.) away from insect-proof netting 20 at the location where these wings are attached to the elongated sides of rain fly 18 (shown as a horizontal straight line in FIG. 1) in order to shed water from the sides and ends of enclosure 10 and avoid a "drip zone" where rain fly 18 is attached to insect-proof netting 20. Such a zone would permit rain water to flow down rain fly 18 directly onto insect netting 20; however, with the wing extension, no rain water will reach insect netting 20. Access zipper, 68, to enclosure 10 will be discussed in more detail in FIG. 4 hereinbelow.

Figure 2:
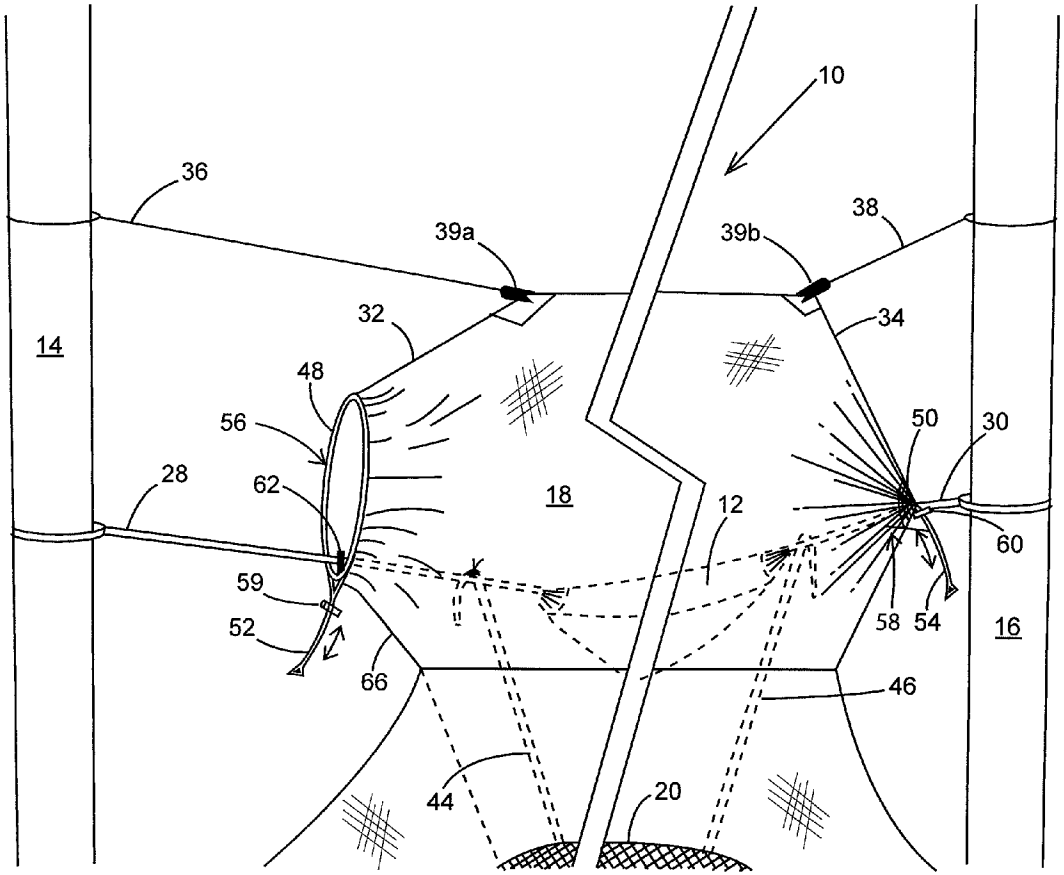
FIG. 2 is a schematic representation of an expanded view of the opposing closable sleeve portions of the rain fly where the load-bearing hammock suspension lines exit the enclosure shown in FIG. 1, hereof.

FIG. 2 is a schematic representation of an expanded view of opposing closable sleeve portions 32 and 34 of rain fly 18, where load-bearing hammock suspension lines 28 and 30 exit enclosure 10, the sleeve portions permitting: (1) enclosure 10 to be assembled without requiring exact centering over hammock 12, while providing protection from weather and insects as long as the openings of the sleeve portions are closed tightly around the suspension lines at both ends of rain fly 18; and (2) enclosure 10 to be used with any camping hammock 12. Shown also in FIG. 2 is the attachment of load-bearing lines, 44, and, 46, from gear sling 22 to hammock support lines 28 and 30, respectively. Attachment may be achieved using a friction knot. Rain fly 18 may be made from waterproofed nylon or other suitable materials, such as cordura or polyester. The materials may be rip stop materials.

Figure 3:
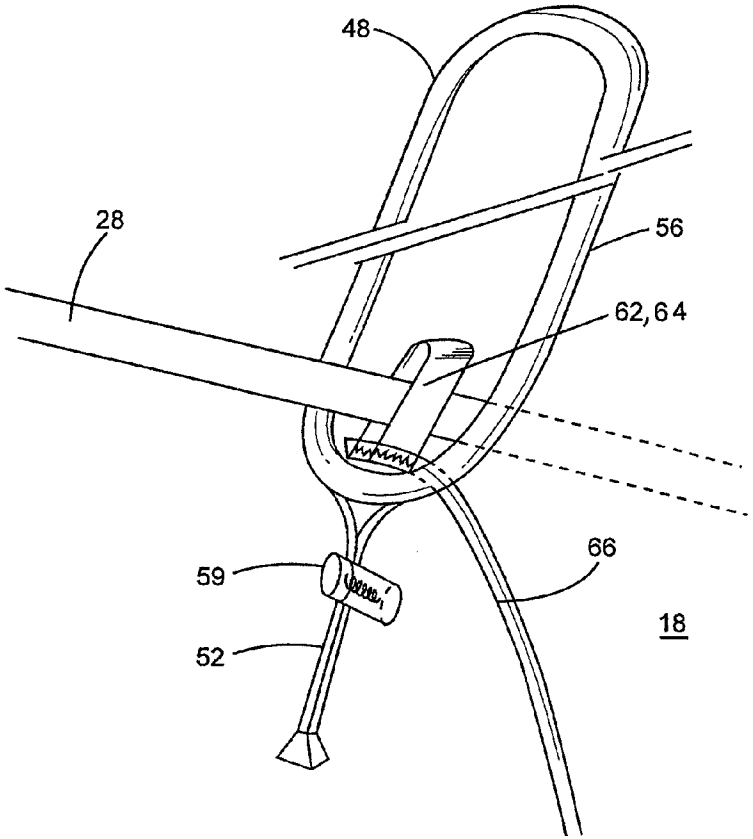
FIG. 3 is a schematic representation of a further expanded view of the opening in each closable sleeve portion shown in FIG. 2, hereof, illustrating an adjustable closure containing a cord for reversibly closing the opening of the sleeve portion, which cord may be fixed in a loosened or tightened condition using a spring-loaded cord lock.

Closures, 48, and 50, of opposing sleeve portions 32 and 34, respectively, are shown in more detail in FIGS. 2 and 3, hereof. Closure draw cords, 52, and, 54, may be movably held in tubular portions, 56, and, 58 (not shown in FIGS. 2 and 3), sewn into the fabric of rain fly near the mouths or openings of sleeves 32 and 34, respectively, or otherwise operationally held by loops, as an example, such that closures 48 and 50 may be drawn closed by tightening cords 52 and 54, respectively, and holding draw cords 52 and 54 using spring-loaded cord locks 59, and, 60, respectively. Clearly, draw cords 52 and 54 may be held using other means, such as knots, as an example. Closures 48 and 50 may be opened by loosening draw cords 52 and 54. Draw cords 52 and 54 may be elastic cords.

When loose, sleeves 32 and 34 have large openings such that hammock suspension lines 28 and 30 may be fed through, or enclosure 10 can be moved to one side of hammock 12. This latter procedure is helpful when gear storage space, and/or weather/bug protection are not required.

Shown also in FIGS. 2 and 3 is elastic shock-absorbing loop, 62, in sleeve 32 with a matching loop, 64 (not shown in FIG. 2), in opposing sleeve 34. Loop 62 is sewn into the lower portion of sleeve 32, and allows loads transmitted through hammock suspension line 28 to be transferred directly to strong seam, 66, in rain fly 18 of enclosure 10 via loop 62, rather than relying on the spring loaded-cord locks 58 and 60 for receiving this loading. If loops 62 and 64 were not provided, the sealing effectiveness of closures 48 and 50 might be compromised when hammock 12 is moved. Thus when hammock suspension lines 28 and 30 are passed through shock-absorbing loops 62 and 64, respectively and pulled taut, any hammock loading is transmitted through loops 62 and 64 rather than to closures 48 and 50.

Figure 4:
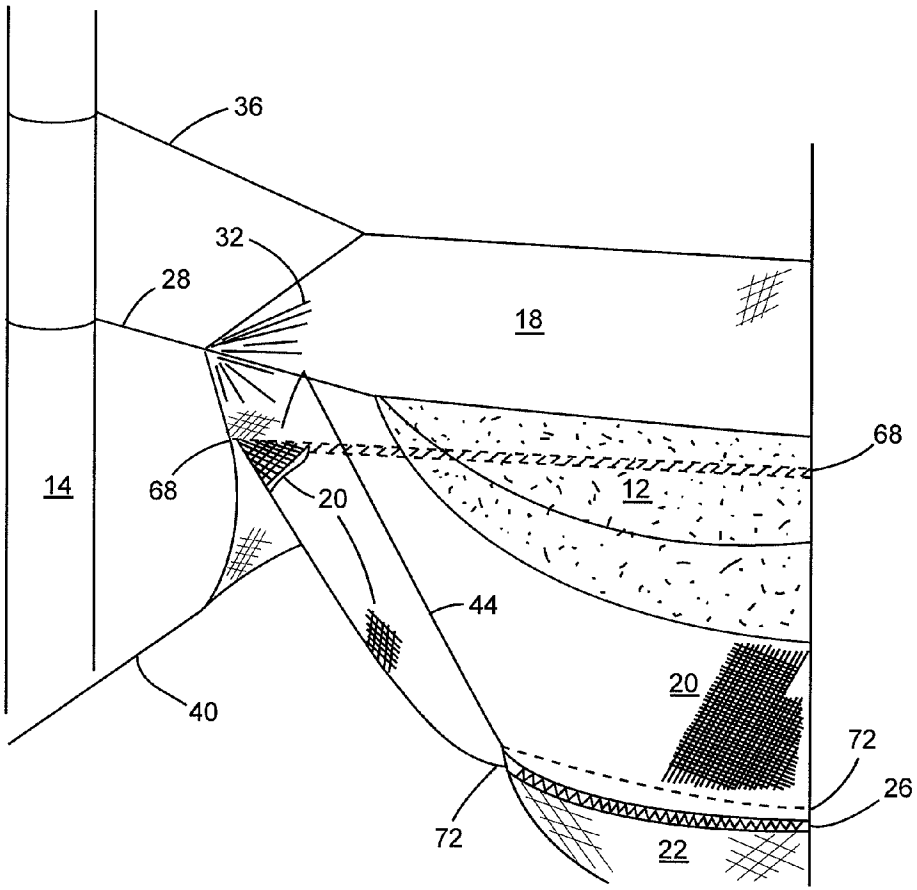
FIG. 4 is a schematic representation of a side, cutaway view of the embodiment of the enclosure shown in FIG. 1, hereof, illustrating the suspended hammock therein, the attachment of the rain fly to the insect netting, the attachment of the insect netting to the load-bearing gear sling, and the load-bearing gear sling having zipper access available from both inside of or external to the enclosure.

FIG. 4 is a schematic representation of a side, cutaway view of the embodiment of enclosure 10 shown in FIG. 1, hereof, illustrating suspended hammock 12 therein and load-bearing gear sling 22 with access available from both inside of or external to the enclosure through zipper 26. FIG. 4 further illustrates access zipper, 68, which provides an entrance to enclosure 10, and permits insect-proof netting 20 to be in part attached to rain fly 18. The attachment of rain fly 18 to insect-proof netting 20 may continue to the far side of enclosure 10 by stitching or other suitable attachment procedures as seam 70 (not shown in FIG. 4) to prevent insects from accessing hammock 12. Line, 72, illustrates where insect netting 20 is attached to gear sling 22 by stitching or other suitable procedures in the far side of enclosure 10, zipper 26 serving this function for at least a portion of the attachment length.

Figure 5:
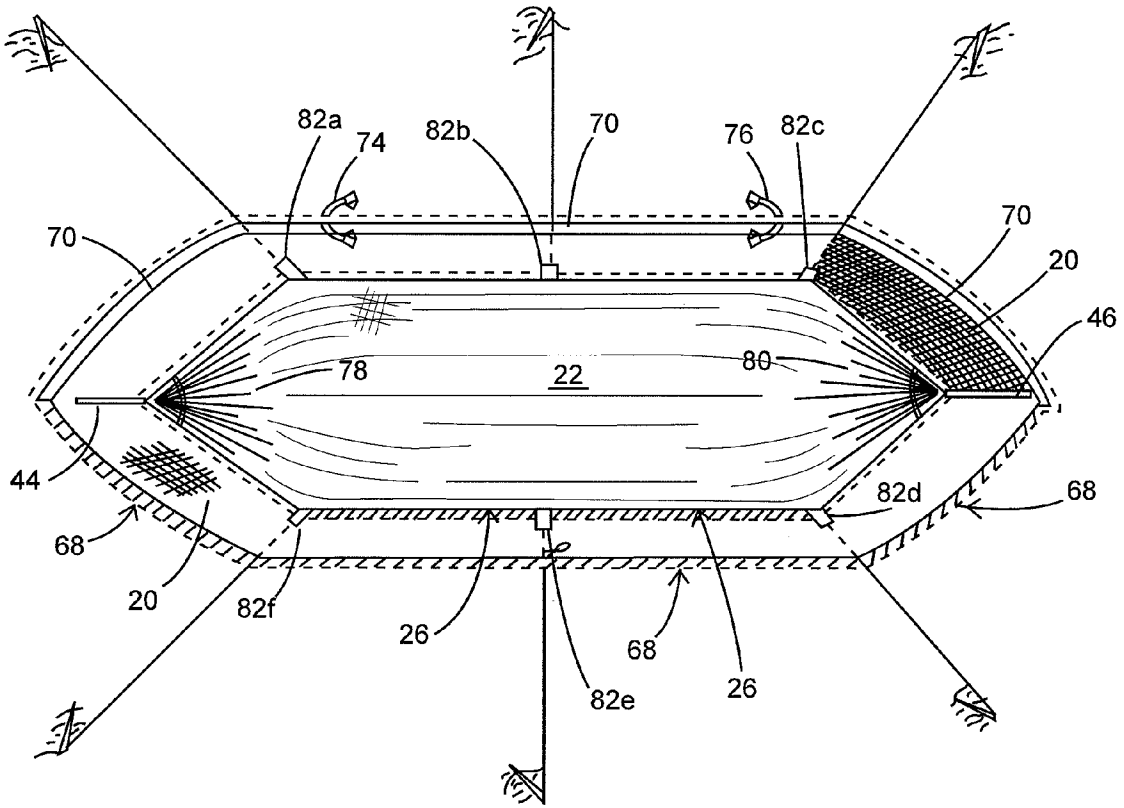
FIG. 5 is a schematic representation of a top cutaway view of the embodiment of the enclosure shown in FIG. 1 hereof, illustrating the load-bearing gear sling shown in FIG. 4, hereof, and the access zipper thereto, as well as the entrance/stowage zipper for the enclosure.

FIG. 5 is a schematic representation of a top cutaway view of the embodiment of enclosure 10 shown in FIG. 1 hereof, illustrating load-bearing gear sling 22 shown in FIG. 4, hereof and access zipper 26 thereto, as well as entrance/stowage zipper 68 for enclosure 10. Zipper 68, in addition to allowing user access to hammock 12, also permits the gear sling and insect netting to be stowed using stow clips, 74, and, 76. Each of clips 74 and 76 may comprise a male connector attached to seam 70 on the inside of the insect netting 20 and a female connector attached to seam 70 on the outside of insect netting 20, as an example, such that when insect netting 20 and gear sling 22 are rolled up, when clipped together, clips 74 and 76 are effective for maintaining insect netting 20 and gear sling 22 in their rolled up condition. Shown also are load bearing lines 44 and 46 for gear sling 22.

As stated hereinabove, load-bearing gear sling 22 may comprise strong waterproof material. At each end of the waterproof gear sling, the material is gathered, 78, and 80, and attached to load bearing lines 44 and 46, respectively, by stitching or other effective procedure, which tightens the fabric in that area and provides a strong load bearing system. Since these lines are attached to load bearing lines 28 and 30 of hammock 12, it is expected that gear sling 22 is capable of supporting significant loads (~200 lbs). Insect netting 20 is sewn to gear sling 22, thereby providing insect-proofing. As also stated hereinabove, gear sling 22 has zipper 26 attached to one longitudinal side for allowing gear access from the outside of enclosure 10. Six webbing loops, **82*a*-82*f*, are attached to the upper portion for allowing gear sling 22 to be anchored to the ground using tent stakes, as an example. Such anchoring additionally provides a user with the ability to stand in gear sling 22**.

The upper portion of insect netting 20 is attached to rain fly 18 by stitching or other suitable procedure. On side opposing zipper access 26 of gear sling 22, user access zipper 68 is sewn to both rain fly 18 and insect netting 20, thereby allowing user access to enclosure 10. The remainder of insect netting 20 is sewn to rain fly 18, thereby creating an insect-proof seal. Stow clips 74 and 76, equally spaced apart from the center of gear sling 22, permit a user to roll up the gear sling 22 and insect netting 20 of enclosure 10, and store it out of the way, thereby allowing more air to flow to hammock 12 for hot weather camping. Although this operation no longer affords a user protection from insects, or being able to use gear sling 22, enclosure 10 maintains shelter from rain.

Figure 6:
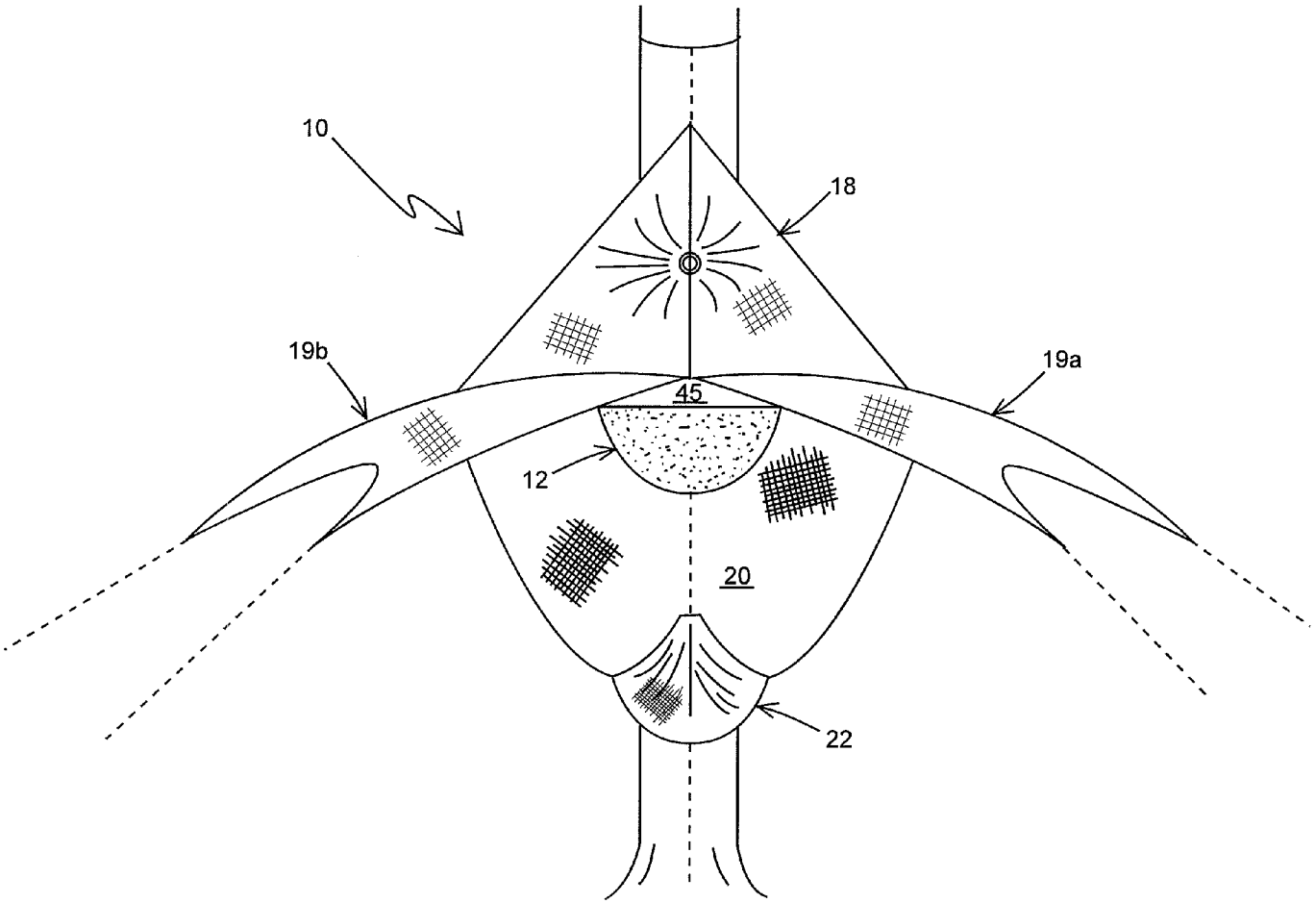
FIG. 6 is a schematic representation of a front view of the enclosure shown in FIG. 1 hereof, illustrating the extension of the wing portions an amount beyond the insect-proof netting effective for preventing precipitation from flowing from the rain fly onto the insect-proof netting on the front and rear portions thereof of the enclosure.

FIG. 6 is a schematic representation of a front view of enclosure 10 shown in FIG. 1 hereof, illustrating the extension, 45, of the wing portions an amount beyond the insect-proof netting effective for preventing precipitation from flowing from the rain fly onto the insect-proof netting on the front and rear portions thereof of the enclosure. The rear view of the enclosure is identical thereto.

The foregoing description of the invention has been presented for purposes of illustration and description and is not intended to be exhaustive or to limit the invention to the precise form disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. An enclosure for a camping hammock having load-bearing suspension lines affixed to opposing ends thereof, comprising:

an elongated, A-frame shaped rain fly effective for protecting said hammock from precipitation, having two long sides each side having a free edge and a common edge disposed above the free edges, said rain fly further having a first closed end and a second closed end at opposing ends thereof extending to the free edge of each side of said rain fly, forming thereby an open end of said rain fly, each of the first end and the second end having a closable sleeve portion, and having an opening through which the suspension lines of said hammock exiting said rain fly are threaded, and attachment locations along the common edge of said rain fly for attaching supporting lines;

two elongated wing portions each having two opposing long edges, one long edge thereof being attached to or integrally formed with the open end of said rain fly, the opposing long edge thereof having attachment locations for stabilizing lines effective for maintaining said rain fly in an expanded condition;

a gear sling disposed below said hammock and protected by said rain fly from precipitation, having attachment locations at opposing ends thereof for attaching at least one supporting line to one of the load-bearing suspension lines affixed to opposing ends of said hammock;

a first zipper; and insect-proof netting attached to said rain fly along the open end thereof in part by said first zipper, and attached to said gear sling;

whereby said hammock is enclosed by said rain fly, said gear sling and said insect-proof netting, thereby protecting said hammock from precipitation and insects.

2. The enclosure of claim 1, further comprising a second zipper for attaching a portion of said netting to said gear sling.

3. The enclosure of claim 1, wherein said gear sling comprises a load-bearing gear sling.

4. The enclosure of claim 1, wherein said gear sling comprises an elongated gear sling.

5. The enclosure of claim 4, wherein said gear sling has attachment locations along the long sides thereof for affixing anchor lines thereto.

6. The enclosure of claim 1, wherein said gear sling has an upward facing opening having an edge to which said insect-proof netting is attached.

7. The enclosure of claim 1, wherein each closable sleeve portion further comprises a flexible tubular portion having an opening; and a draw cord having two free ends enclosed by the tubular portion, such that both ends of said draw cord exit the opening in the tubular portion.

8. The enclosure of claim 7, wherein said draw cord is secured using a spring-loaded cord lock.

9. The enclosure of claim 7, wherein said draw cord comprises an elastic draw cord.

10. The enclosure of claim 1, wherein each closable sleeve portion comprises a shock-absorbing loop through which one load-bearing line of said hammock is threaded, attached to the lower portion of the sleeve in the vicinity of the opening thereof.

11. The enclosure of claim 1, wherein said rain fly comprises waterproofed nylon.

12. The enclosure of claim 1, wherein said gear sling comprises waterproofed nylon.

13. The enclosure of claim 1, wherein said wing portions comprise waterproofed nylon.

14. The enclosure of claim 1, wherein said wing portions extend beyond said insect-proof netting to keep precipitation from flowing down said rain fly onto said insect-proof netting.

* * * * *